United States Patent [19]

Demizu et al.

[11] Patent Number: 4,930,438

[45] Date of Patent: Jun. 5, 1990

[54] DEVELOPING DEVICE USING A SINGLE COMPONENT DEVELOPER

[76] Inventors: Hiromi Demizu, 2-8-19, Azamino, Midori-ku, Yokohama-shi, Kanagawa-ken; Makoto Obu, 7-1-7-106, Minami-kasai, Edogawa-ku, Tokyo; Hidetoshi Yano, Lion's Dai-3-Fujigaoka #506, 1-8-14, Fujigaoka, Midori-ku, Yokohama-shi, Kanagawa-ken; Ryubun Seimiya, 7-16-7, Tamadaira, Hino-shi, Tokyo; Noriyoshi Tarumi, Nanyodai 47-1, 168-38, Shimoyugi, Hachioji-shi, Tokyo, all of Japan

[21] Appl. No.: 113,331

[22] Filed: Oct. 21, 1987

Related U.S. Application Data

[63] Continuation of Ser. No. 760,404, Jul. 30, 1985, abandoned.

[30] Foreign Application Priority Data

| | | | |
|---|---|---|---|
| Aug. 7, 1984 | [JP] | Japan | 59-164247 |
| Aug. 8, 1984 | [JP] | Japan | 59-120909 |
| Aug. 8, 1984 | [JP] | Japan | 59-164800 |
| Aug. 8, 1984 | [JP] | Japan | 59-164801 |
| Aug. 8, 1984 | [JP] | Japan | 59-164802 |
| Aug. 10, 1984 | [JP] | Japan | 59-166545 |

[51] Int. Cl.[5] ..... G03G 15/08

[52] U.S. Cl. ..... 118/651; 118/653; 118/656; 355/253; 355/259; 355/261

[58] Field of Search ..... 118/651, 653, 656; 430/120, 123; 355/3 DD, 253, 259, 261

[56] References Cited

U.S. PATENT DOCUMENTS

| | | | |
|---|---|---|---|
| 4,036,175 | 7/1977 | Phillips et al. | 118/651 |
| 4,083,326 | 4/1978 | Kroll et al. | 118/661 |
| 4,370,049 | 1/1983 | Kuge et al. | 118/651 X |
| 4,382,420 | 5/1983 | Ohnuma et al. | 118/651 |
| 4,656,964 | 4/1987 | Kanno et al. | 118/651 X |

FOREIGN PATENT DOCUMENTS

| | | | |
|---|---|---|---|
| 0071466 | 2/1983 | European Pat. Off. . | |
| 0087074 | 8/1983 | European Pat. Off. . | |
| 0150581 | 8/1985 | European Pat. Off. . | |
| 53-35550 | 4/1978 | Japan . | |
| 54-17030 | 2/1979 | Japan . | |
| 59-126567 | 7/1984 | Japan | 355/3 DD |

OTHER PUBLICATIONS

English Translation of Japanese Kokai Patent No. 59-126567, Washington, D.C., U.S. Patent and Trademark Office, Jun. 1988.

IBM Technical Disclosure Bulletin, vol. 1, No. 3, Oct. 1958, p. 6, N.Y., U.S.; Schaffert, R. M., "Development of Electrostatic Images," p. 6, line 1-4; FIG. 1.

*Primary Examiner*—Evan Lawrence

[57] ABSTRACT

A developing device employing a non-magnetic one-component toner is provided and it includes a developing sleeve, which is driven to rotate in a predetermined direction past a developing region where toner carried on the sleeve is supplied to develop an electrostatic latent image formed on an image bearing member, a tank for storing therein a quantity of non-magnetic one-component toner and a flexible supply roller generally disposed between the tank and the developing sleeve for supplying the toner from the tank to the developing sleeve. The flexible supply roller rotates so as to be in sliding contact with the developing sleeve. With the provision of such a supply roller, even non-magnetic one-component toner can be suitably supplied to the developing sleeve to form thereon a thin film of charged toner for use in developing an electrostatic latent image.

26 Claims, 8 Drawing Sheets

DEVELOPING DEVICE USING A SINGLE COMPONENT DEVELOPER

This is a continuation of application Ser. No. 06/760,404, filed July 30, 1985, now abandoned.

BACKGROUND OF THE INVENTION

1. Field of the Invention

This invention generally relates to a device for developing an electrostatic latent image formed on an image bearing member by application of a thin film of toner particles charged to a predetermined polarity, and, in particular, to a developing device for developing an electrostatic latent image using a single component developer, in particular, a non-magnetic single component developer.

2. Description of the Prior Art

A developing device is commonly used for developing an electrostatic latent image formed on an image bearing member, such as a photosensitive member, in electrophotographic or electrostatic recording system. One type of such a developing device uses a two-component developer comprised of toner and carrier beads and there is another type which uses a one-component developer having no carrier beads. In the former type, development can be carried out relatively stably and a developed image of excellent quality can be obtained; however, the mixture ratio between toner and carrier beads must be maintained properly so that there must be provided a mechanism therefor which tends to complicate the structure of imaging systems.

It is thus desirous to use a developing device employing a one-component developer. Such a one-component developer is typically comprised of a mixture of toner and a magnetic material which serves as the carrier beads in the two-component developing system. In a developing device using such a one-component developer containing a mixture of toner and a magnetic material, typically, a developing sleeve is rotatably provided with a magnet roll disposed therein so that the one-component developer is magnetically attracted to the peripheral surface of the developer sleeve. And, a thin film of one-component developer formed on the developing sleeve and charged to a predetermined polarity is applied to an electrostatic latent image for development thereof.

In this manner, in a prior art developing device using a one-component developer, the developer itself is made to be magnetically attractable and thus it is carried on the developing sleeve as magnetically attracted thereto and then it is electrically transferred to the image bearing member having an electrostatic latent image selectively from the developing sleeve. Thus, the so-called one-component developer is required to contain therein a magnetic material in addition to a coloring material, such as carbon black, and, thus, the manufacture of a developer is rather limited as far as selection of material is concerned. It is thus desired to provide a developing device which is capable of using a non-magnetic one-component developer.

SUMMARY OF THE INVENTION

In accordance with the present invention, there is provided a developing device capable of using a non-magnetic one-component developer, which includes carrier means for carrying the developer along a predetermined path including a developing station where an electrostatic latent image is developed by the developer and developer supplying means for supplying the developer to the carrier means so as to be carried thereon as attracted thereto. In the preferred embodiment, the carrier means includes a developing sleeve which is rotatably supported and the developer supplying means includes a supply roller which is in scrubbing contact with the developing sleeve so as to have the developer carried on the developing sleeve as attracted thereto. The attractive force in this case mainly relies on such forces as electrostatic forces and Van der Waals forces and not on magnetic forces as in the prior art.

It is therefore a primary object of the present invention to obviate the disadvantages of the prior art as described before and to provide a developing device capable of using a one-component developer, magnetic or non-magnetic, for developing an electrostatic latent image.

Another object of the present invention is to provide a developing device compact in size, high in performance and reliable in operation.

A further object of the present invention is to provide a developing device particularly suitable for use in color development.

Other objects, advantages and novel features of the present invention will become apparent from the following detailed description of the invention when considered in conjunction with the accompanying drawings.

DESCRIPTION OF THE PREFERRED EMBODIMENTS

Figure 1:
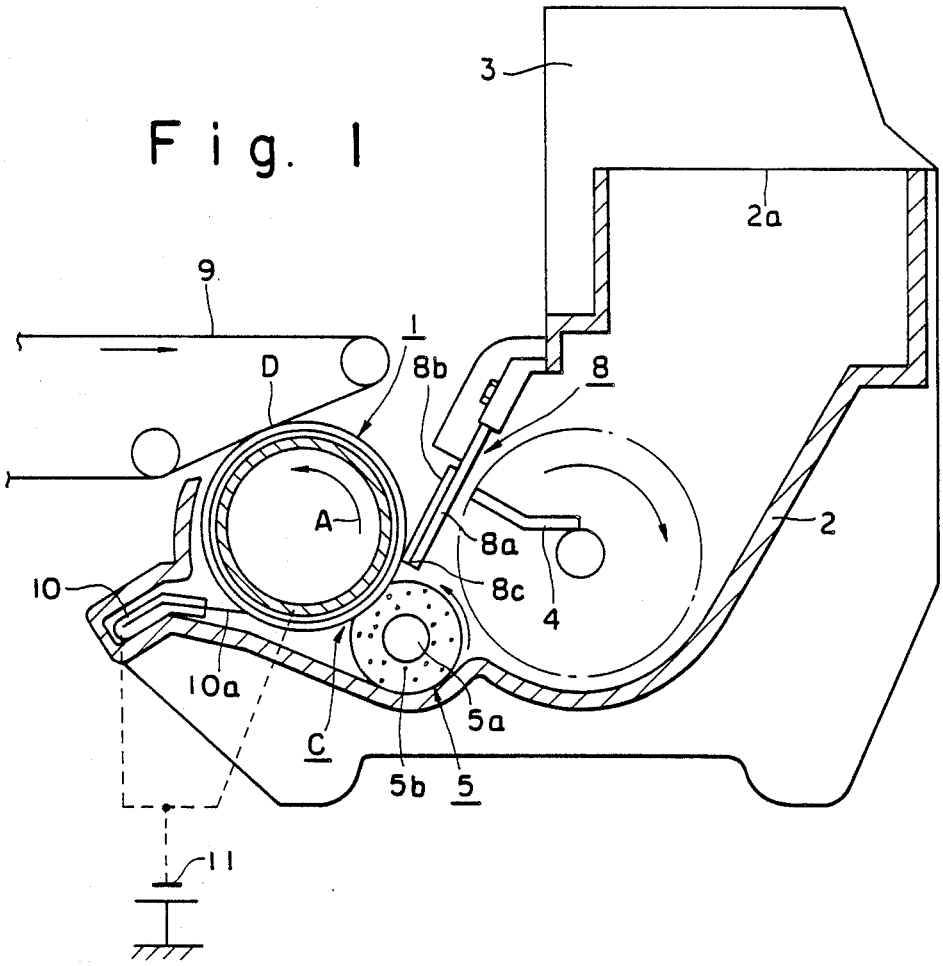
FIG. 1 is a schematic illustration showing a developing device constructed in accordance with one embodiment of the present invention.
Figure 2:
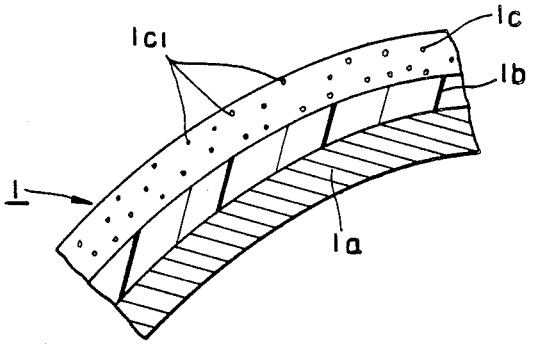
FIG. 2 is a schematic illustration in cross section showing the detailed structure of a developing sleeve employed in the structure of FIG. 1.

Referring now to FIG. 1, there is schematically shown a developing device constructed in accordance with one embodiment of the present invention, which uses a non-magnetic one-component developer. As shown, the developing device includes a developing sleeve 1 which is rotatably supported and driven to rotate at constant speed in the direction indicated by the arrow A or counterclockwise in the illustrated example. As shown in FIG. 2, the developing sleeve 1 is comprised of a cylindrical support la of an electrically conductive material, such as aluminum, an electrically insulating layer 1*b* formed on the cylindrical support 1*a* from an electrically insulating material, such as chloroprene, and an electrode layer 1c formed on the insulating layer 1b and containing therein a number of electrode particles $1c_1$ which are electrically isolated from one another. In the preferred embodiment, the electrode layer 1c is formed such that fine particles or filaments of electrically conductive material, such as carbon black, are mixed with an electrically insulating material, such as epoxy resin, as uniformly dispersed therein, and such a mixture is applied to the outer peripheral surface of the insulating layer 1b thereby forming the electrode layer 1c which contains therein a number of fine electrode particles isolated from one another. It is to be noted that use may also be made of metal powder, such as copper powder, as a material for the fine electrode particles which are electrically floating. On the other hand, as the matrix material for keeping the fine electrode particles in the electrically floating state, use may also be made of various resins, such as acrylic family, urethane family, styrene family, acrylic-urethane family, epoxy-silicon or epoxy-teflon family. However, it should be selected in consideration of the triboelectric series in connection with the developer or toner used so as to be capable of triboelectrically charging the developer efficiently.

With the use of the developing sleeve 1 having the electrode layer 1c as illustrated in FIG. 2, since the floating fine electrodes $1c_1$ embedded in the electrode layer 1c effectively serves a function similar to that of carrier beads in the two-component developer, a suitably increased image density due to edge effect can be obtained for a line image even if use is made of a one-component developer. It should also be noted that, as compared with a metal or the like, an electrically insulating material, such as an epoxy resin, containing therein a low resistivity material, such as carbon black, as the fine floating electrodes, has a higher affinity to the developer, so that even a non-magnetic one-component developer can be carried on the outer peripheral surface of the developing sleeve 1 as attracted thereto without presence of a magnetic force. In this case, the developer or toner is mainly attracted to the developing sleeve 1 electrostatically and/or due to Van der Waals force.

In the illustrated embodiment, the electrically conductive support 1a of the developing sleeve 1 is connected to a bias source 11 and it is maintained at a potential same as that of a discharging brush 10 which is in sliding contact with the outer peripheral surface of the developing sleeve 1 as will be described in detail later. The insulating layer 1b is provided to define an electric field suitable for the intended development, but this layer 1b may be discarded, if desired.

To the right of the developing sleeve 1 in FIG. 1 is provided a hopper 2 for storing therein a quantity of developer. As mentioned previously, the developer used in the present developing device is a non-magnetic one-component developer, and, thus, a selection may be made from a wide range of materials in forming such a developer. The hopper 2 has an inlet port 2a at its top where a toner cartridge 3 may be detachably mounted so that the developer may be damped into the hopper 2 through the inlet port 2a from the cartridge 3. Inside of the hopper 2 is provided an agitator 4 which is driven to rotate as indicated by the arrow to prevent the developer inside the hopper 2 from forming clumps and to tend to move the developer inside of the hopper 2 generally toward an outlet port defined at bottom left in FIG. 1 and thus toward the developing sleeve 1.

Adjacent to the outlet port of the hopper 2, there is disposed a developer supplying roller 5 for positively supplying the developer from the hopper 2 to the developing sleeve 1. The developer supplying roller 5 is rotatably supported such that its outer peripheral surface is pressed against the outer peripheral surface of the developing sleeve 1, and the developer supplying roller 5 is preferably driven to rotate in the same direction as the developing sleeve 1. As the developing sleeve 1 and the developer supplying roller 5 are driven to rotate in the same direction, or counterclockwise direction, in the illustrated embodiment, the developing sleeve 1 and the developer supplying roller 5 moves slidingly opposite in direction under pressure at a contact section C therebetween. With this structure, the developer becomes scrubbed as well as sandwiched between the developing sleeve 1 and the developer supplying roller 5 so that the developer can be charged triboelectrically at high efficiency. At the same time, there is formed a developer film of desired thickness on the outer peripheral surface of the developing sleeve 1 as attracted thereto. In this case, the developer becomes attracted to the developing sleeve 1 mainly due to electrostatic attraction.

The desired peripheral speed of the developer supplying roller 5 differs depending on the peripheral speed of the developing sleeve 1; however, in general, the peripheral speed of the developer supplying roller 5 is set higher than the peripheral speed of the developing sleeve 1 thereby establishing a sliding contact between the sleeve 1 and the roller 5. It should be noted that if these peripheral speeds are set to be too high, then problems can ensure, such as developer scattering and clumping of developer in the hopper 2, so that these peripheral speeds should be set appropriately taking into account various considerations as described above. Preferably, the developer supplying roller 5 is comprised of a material at least at its outer peripheral surface which is separated far away in the triboelectric series from the material forming the developer so as to carry out triboelectric charging of the developer efficiently.

In the illustrated embodiment, the developer supplying roller 5 is a sponge roller which includes a cylindrical support 5a and a surface layer 5b made of an elastic material, such as polyurethane foam having the degree of foaming of 10–100 in terms of number of cells, and the sponge roller 5 is driven to rotate in the same direction as that of the developing sleeve 1 as pressed thereagainst. In the preferred embodiment, the developing sleeve 1 having the diameter of 25.4 mm is driven to rotate at 400 r.p.m. and the sponge roller 5 having the diameter of 14 mm is driven to rotate at 800 r.p.m. so that the ratio of the peripheral speeds between them is approximately 10:11. In order to transport the developer to the contact area C by an appropriate amount and to form a thin film of developer on the peripheral surface of the developing sleeve 1, it is better that the elastic material forming the sponge roller 5 has a higher hardness and smaller-sized pores.

With the provision of the sponge roller 5 as described above for supplying the developer to the developing sleeve 1, the developer stored in the hopper 2 is stirred by the agitator 4 and is supplied to the contact portion C following the rotation of the sponge roller 5. At the contact portion C, the developer carried on the sponge roller 5 becomes scrubbed as sandwiched under pressure between the developing sleeve 1 and the sponge roller 5, which move in opposite directions, so that the developer becomes charged triboelectrically and at the same time transferred to the developing sleeve 1. In this case, the developer is mainly attracted to the sponge roller 5 electrostatically due to friction between the sponge roller 5 and the developer which is pushed toward the sponge roller 5 by the rotation of the agitator 4. In this manner, in the present developing device, even if the developer used is comprised of non-magnetic one-component toner having no magnetic material or carrier beads, the developer is suitably transferred to the peripheral surface of the developing sleeve 1 from the hopper 2.

Figure 3:
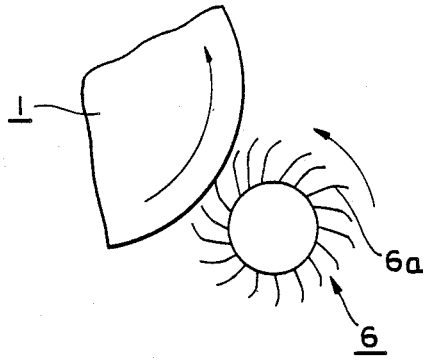
FIGS. 3 through 5 are schematic illustrations showing various alternative examples of a developer supplying unit to be provided in the structure of FIG. 1.
Figure 4:
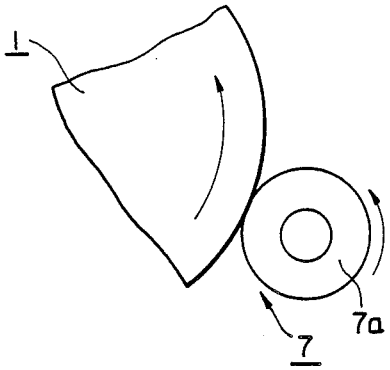
Figure 5:
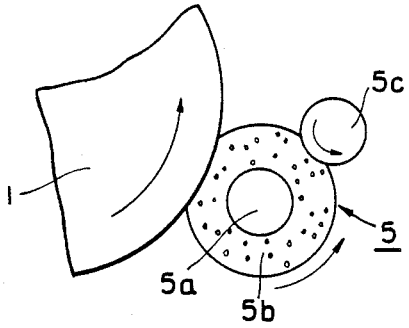

Now, several embodiments of the developer supplying unit 5 will be described with reference to FIGS. 3 through 5. FIG. 3 shows an embodiment in which use is made of a fur brush 6 as the developer supplying unit 5. The fur brush 6 is rotatably supported and driven to rotate in the direction indicated by the arrow and it includes brushing filaments 6*a* which are preferably comprised of nylon, rayon, electrically conductive rayon, etc. With such a fur brush 6, the developer is transferred to the developing sleeve 1 from the hopper 2 smoothly, as with the sponge roller 5 of the previous embodiment. Alternatively, as shown in FIG. 4, use may also be made of a roller 7 having a surface layer 7*a* which is comprised of a metal which is neither elastic nor porous. In this embodiment, as a material for the surface layer 7*a*, a selection may be made from a wide range of rubber and various plastic materials as long as it can satisfy the above-described charging characteristics. Preferably, use is made of an electrically conductive material because the roller 7 then also serves to remove undesired residual charge remaining on the peripheral surface of the developing sleeve 1, and thus to some extent serves the function of a discharging unit which will be described later. FIG. 5 shows a further modification in the case of using the sponge roller 5 in which an additional roller 5*c* is provided to be in pressure contact with the sponge roller 5 so as to prevent the developer from plugging the pores of the surface layer 5*b*.

Referring again to FIG. 1, downstream of the developer supplying unit 5 with respect to the direction of rotation of the developing sleeve 1 is disposed a doctor blade 8 which has its tip end pressed against the outer peripheral surface of the developing sleeve 1 so as to have the developer attracted to the developing sleeve 1 regulated in thickness to form a thin film of charged developer. In the illustrated embodiment, the doctor blade 8 includes a support main body 8*a* of an elastic material, on one surface of which is provided an electrically insulating film 8*b* of a fluorine family resin, e.g., tetrafluoroethylene-perfluoroalkylvinylether copolymer (PFA), and, thus, the insulating film 8*b* is in sliding contact with the developing sleeve 1 under pressure. Since it is so structured that the doctor blade 8 has its free end portion 8*c* pressed against the peripheral surface of the developing sleeve 1, there can be formed in a stable manner a thin film of charged developer uniform in thickness across a desired width of the developing sleeve 1. Besides, the insulating film 8*b* is provided on the main body 8*a* so as to prevent the developer from being stuck thereto and to improve the charging characteristic. With the use of the insulating film 8*b* comprised of a fluorine family material as in the present embodiment, the developer can be prevented from being stuck thereto and can be charged to a predetermined polarity more efficiently.

Other than the above-described PFA material, use may also be made of such fluorine family high polymer materials as polytetrafluoroethylene (TFE), tetrafluoroethylene-hexafluoropropylene copolymer (ETFE), and polychlorotrifluoroethylene (PCTFE), and a material containing a fluorine family high polymer material, and, furthermore, a material, such as polyethylene, polypropylene and silicon resin, which has high separating characteristics with respect to the developer or toner is preferable. Besides, in order to improve the wear resistant characteristic, an additive, such as carbon black, carbon fibers, glass fibers, silica micro powder, SiC micro powder, can be added, if desired.

As also shown in FIG. 1, downstream of the doctor blade 8 with respect to the direction of rotation of the developing sleeve 1 is defined a developing station D through which a circular path of transportation for the developer carried on the outer peripheral surface of the developing sleeve 1 passes, and also an organic photosensitive (OPC) belt 9 in the form of an endless belt for bearing thereon an image passes. Typically, the OPC belt 9 is in rolling contact with the developing sleeve 1 at the developing station D, though they may be so disposed with a predetermined gap therebetween, if desired. As is obvious for one skilled in the art, an electrostatic latent image is formed on the OPC belt 9, for example, by charging the belt 9 to a predetermined polarity uniformly and then exposing the thus charged belt 9 to a light image thereby having the uniform charge dissipated selectively in accordance with the light image, and the latent image formed on the belt 9 is then moved past the developing station D. As described previously, since the developing sleeve 1 carries thereon a thin film of charged developer, the developer is applied to the latent image on the OPC belt 9 so that the developer is selectively transferred from the developing sleeve 1 to the OPC belt 9 thereby developing the latent image. It is to be noted that the developer used is non-magnetic in nature, so that the developer is attracted to the developing sleeve 1 mainly due to electrostatic force and Van der Waals force; however, the total attractive force acting between the developer and the developing sleeve 1 can be set easily less than the total attractive force acting between the developer and the electrostatic latent image on the OPC belt 9 so that development can be carried out at high efficiency.

As also shown in FIG. 1, there is disposed a discharging brush 10 downstream of the developing station D with respect to the direction of rotation of the developing sleeve 1 for removing the undesired charge remaining on the peripheral surface of the developing sleeve 1. Since the developing sleeve 1 is in sliding contact with the developer supplying unit 5, doctor blade and possibly OPC belt 9, its peripheral surface tends to bear charge having the polarity which is not desired for development at the developing station D. Such undesired charge could cause deterioration of image quality, such as background contamination and streaking, and, therefore, it is required to be removed securely. In particular, the charge accumulated on an insulating material such as epoxy resin, which the electrode layer 1*c* of the developing sleeve 1, is hard to remove as compared with the case of the charge accumulated on a metal, and, thus, it is desired to provide a discharging unit capable of removing such undesired charge most efficiently. In the illustrated embodiment, the discharging brush 10 is so provided that its electrically conductive brush 10*a* is oriented in the tailing fashion so as to be lightly pressed against the developing sleeve 1 by its own elasticity. With this structure, the brush 10*a* may be set in sliding contact with the developing sleeve 1 uniformly over a desired width, thereby obtaining a uniform discharging effect stably. In the illustrated embodiment, the discharging brush 10 is electrically connected to the bias voltage source 11 so that its potential is maintained at the same level as that of the electrically conductive support 1*c* of the developing sleeve 1. With this arrangement, the undesired charge accumulated and the residual charge remaining on the developing sleeve 1 can be removed efficiently and selectively.

The residual developer remaining on the developing sleeve 1 is subjected to charge removing operation by the discharging unit 10 so that the residual developer now is attracted to the developing sleeve 1 less strongly, and as the developer sleeve 1 further rotates, the residual developer now attracted to the developing sleeve 1 less strongly is also transported to the position where the developer supplying unit 5 is disposed, and, thus, the residual developer is separated away from the developing sleeve 1 for use in a later developing process. In the illustrated embodiment, since the sponge roller 5 (when used); as the developer supplying unit rotates in sliding contact with the developing sleeve 1 under pressure, the residual developer carried on the developing sleeve 1 can be easily and effectively separated away from the developing sleeve 1. That is, the sponge roller S is pressed against the developing sleeve 1 so that its peripheral surface is somewhat deformed thereby defining an area contact condition at the contact portion C between the developing sleeve 1 and the sponge roller 5. Thus, the sponge roller 5 has a dual function of supplying the developer to the developing sleeve 1 at the downstream end of the area contact portion C and of removing the residual developer from the developing sleeve 1 at the upstream end of the area contact portion C. When the residual developer is removed from the developing sleeve 1, it is then transported into the hopper 2 due to the counterclockwise rotation of the sponge roller 5, for use in subsequent developing operation.

In the above-described embodiment, the developer is triboelectrically charged and regulated in thickness at the same time at the area contact portion C between the developing sleeve 1 and the sponge roller 5, and, then, the developer now carried on the developing sleeve 1 as attracted thereto is further charged and is regulated in thickness by means of the doctor blade 8. It is to be noted, however, that the doctor blade 8 can be discared, if desired, as long as charging and thickness regulating functions afforded by the area contact C between the developing sleeve 1 and the sponge roller 5 are sufficient. Moreover, in the above-described embodiment, use has been made of a non-magnetic one-component developer; however, it should be noted that the present developing device may also be used with a magnetic one-component developer, if desired. Even in this case, there may be no need to provide a magnet roll inside of the developing sleeve 1. Besides, the present developing device can also be used with a drum-type photosensitive member instead of the endless belt-type photosensitive member used in the above-described embodiment. When used with the drum-type photosensitive member, it is preferable to form the developing sleeve 1 to be elastic in nature if it is to be pressed against such a drum-type photosensitive member. In this case, the insulating layer 1*b* may be comprised of an elastic insulating material. In the case where a magnet roll is disposed inside of the developing sleeve 1 for some reason, the doctor blade 8 may be preferably comprised of an elastic, magnetic material at least partly, in which case the doctor blade 8 is preferably provided with its base end pivotally supported such that the free end of the doctor blade 8 can be pressed against the developing sleeve 1 due to magnetic attraction.

Figure 6:
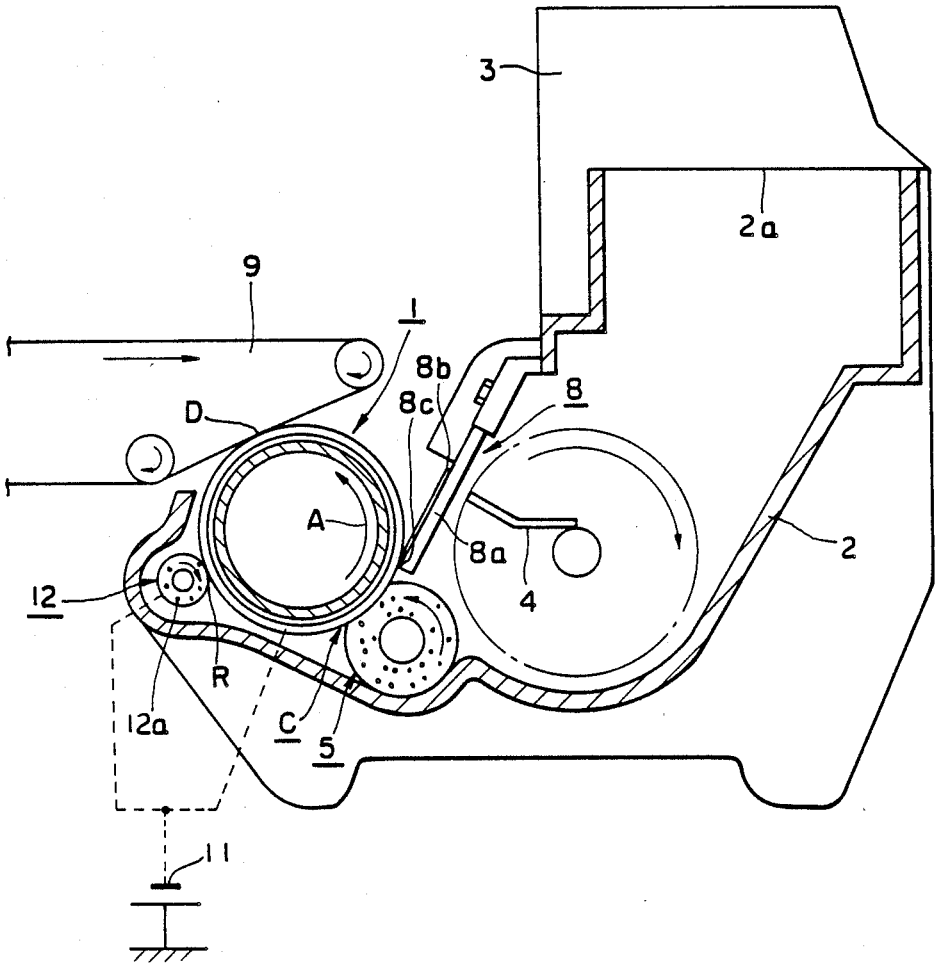
FIG. 6 is a schematic illustration showing a developing device constructed in accordance with another embodiment of the present invention.

FIG. 6 shows another embodiment of the present developing device which is structurally similar in many respects to the previous embodiment and in which a discharging roller 12 is provided as being in rolling contact with the developing sleeve 1 for removing the undesired charge accumulated thereon. It is to be noted that like numerals indicate like elements as practiced throughout the present specification and drawings and a repeated description of the same elements will be avoided as much as possible. The discharging roller 12 is comprised of a sponge roller having an outer peripheral surface which is brought into rolling contact with the peripheral surface of the developing sleeve 1 at a rolling contact portion R and which has been treated to be electrically conductive. The discharging roller 12 is driven to rotate opposite in rotating direction to the developing sleeve 1. With the provision of such a rotating discharging unit in rolling contact with the developing sleeve 1, the discharging unit 12 may contact a required region on the outer peripheral surface of the developing sleeve 1 uniformly at all times, so that the discharging effect can be obtained stably without irregularities. In particular, the discharging roller 12 comprised of a sponge roller in the illustrated embodiment can follow the developing sleeve 1 pliantly keeping in rolling contact therewith, so that an enhanced discharging effect can be attained.

Since the discharging roller 12 is in rolling contact with developing sleeve 1, the developer remaining on the developing sleeve 1 is not disturbed substantially and only the undesired charge can be removed. Since the residual developer is not removed from the developing sleeve 1 at this section, the developer is prevented from being accumulated around the discharging roller 12, which would require the provision of transporting mechanism to transport such removed developer to the hopper 2. As other types of rotating discharging unit, use may also be made of a metal roller, a fur brush roller having a brush of electrically conductive material, a roller having an electrically conductive felt at its surface, an electrically conductive rubber roller, etc., instead of the sponge roller 12 as described above.

As also indicated in FIG. 6, the discharging roller 12 has its surface section 12*a* which is electrically conductive as described above and which is electrically connected to the bias voltage source 11 so as to be maintained at the potential same as that of the electrically conductive support 1*c* of the developing sleeve 1. And, thus, a predetermined developing bias voltage is also applied to the discharging roller 12. With this arrangement, the accumulated charge on the electrode layer 1*c* comprised of a mixture of an epoxy resin and carbon black of the developing sleeve 1 and the charge of the residual developer remaining on the developing sleeve 1 can be removed effectively as well as selectively.

Figure 7:
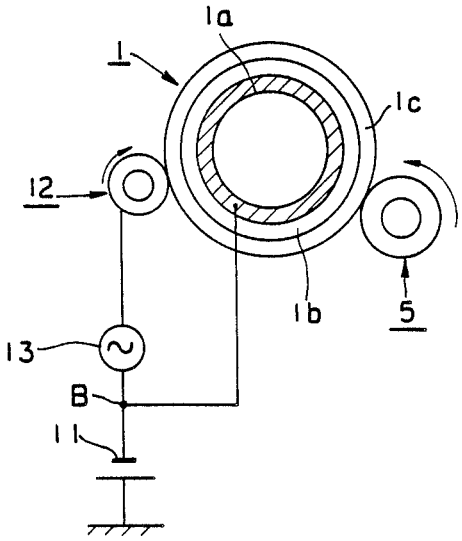
FIG. 7 is a schematic illustration showing a modification of the structure shown in FIG. 6.

FIG. 7 shows a further modification in which an a.c. bias voltage source 13 is provided as connected between the discharging roller 12 and a node B between the d.c. bias voltage source 11 and the conductive support 1*a* of the developing sleeve 1. In this modified structure, the discharging roller 12 receives a developing bias voltage superimposed with an a.c. bias voltage. Such a structure allows to attain an enhanced discharging characteristic stably.

Figure 8:
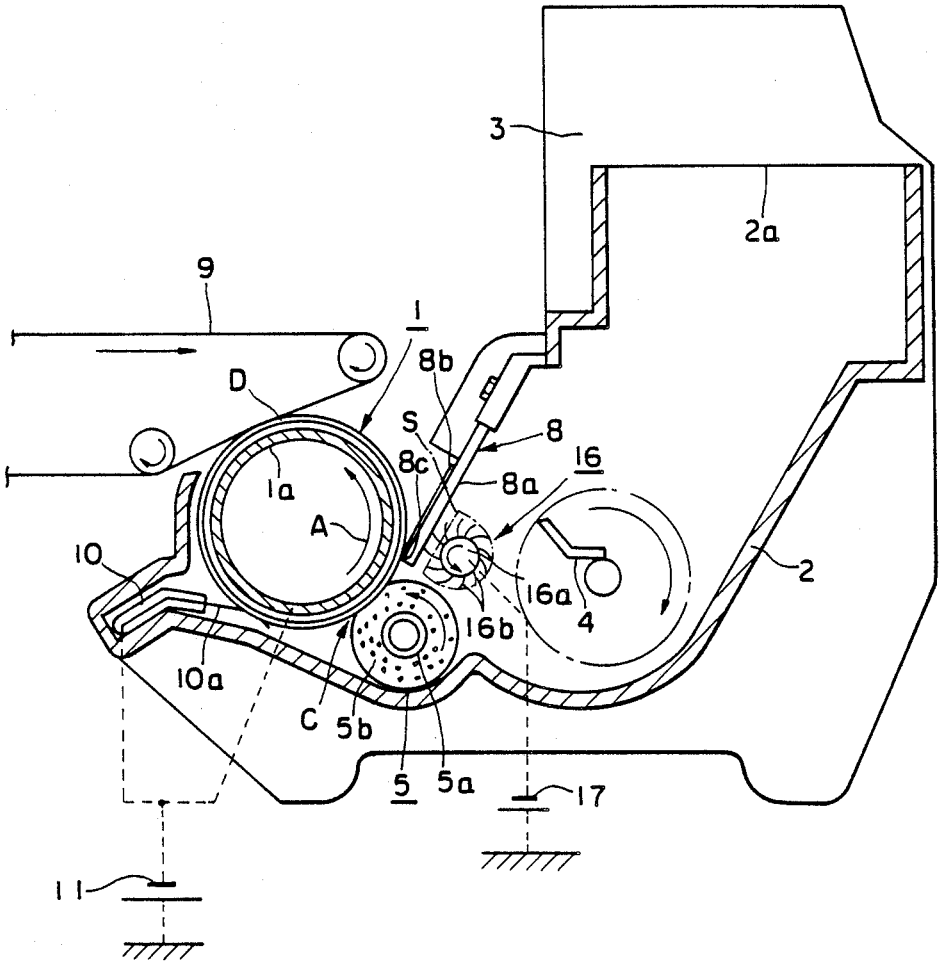
FIGS. 8 through 11 are schematic illustrations showing various other embodiments of the present invention.

FIG. 8 shows a further embodiment of the present developing device which is also structurally similar in many respects to the previously described embodiments. In the present embodiment, however, a fur brush 16 is rotatably provided for preventing the developer from agglomerating or forming clumps, and is disposed between the doctor blade 8 and the developer supplying unit 5. Since the doctor blade 8 has its free end in pressure contact with the developing sleeve 1 for regulating the amount of developer to be attracted to the developing sleeve 1, the the developer which has been prevented by blade 8 from being carried on the developing sleeve 1 as attracted thereto tends to move back toward the developer supplying roller 5 and merge with the developer which has been moved toward the developing sleeve 1 due to the rotation of the developer supplying roller 5 to form a stagnating developer region S between the doctor blade 8 and the developer supplying roller 5. In this stagnating region S, the developer tends to agglomerate or form clumps, which can adversely affect the formation of a thin film of uniformly charged developer on the developing sleeve 1.

Under the circumstances, in accordance with this embodiment of the present invention, the fur brush 16 is disposed in the stagnating region S and driven to rotate in the rotating direction as the developer supplying roller 5 at a predetermined speed thereby keep the developer from agglomerating in the stagnating region S. This fur brush 16 is preferably comprised of an electrically conductive roll 16*a* and an electrically conductive brush 16*b* fixedly mounted on the peripheral surface of the roll 16*a*. With this structure, the developer which can otherwise tend to stay in the stagnating region S is forced to move toward the agitator 4 so that the developer is not only prevented from agglomerating but also transported toward the hopper 2 for possible subsequent use.

In the illustrated embodiment, the fur brush 16 is electrically connected to another bias voltage source 17 of predetermined polarity, so that it also serves to remove by contact and selectively the charge of undesired polarity for development born by the developer selectively by contact. Thus, the provision of fur brush 16 contributes not only to prevent the occurrence of developer clumps but also to enhance the charging efficiency of the developer, for example, by the doctor blade 8. It is to be noted that the fur brush 16 may be replaced by any other stirring member, such as agitator 4. Moreover, the fur brush 16 may be connected to ground instead of the bias source 17, if desired, and, in the case where there is no need to employ the fur brush 16 to remove undesired charge from the developer, the fur brush 16 may be comprised of an electrically insulating material.

Figure 9:
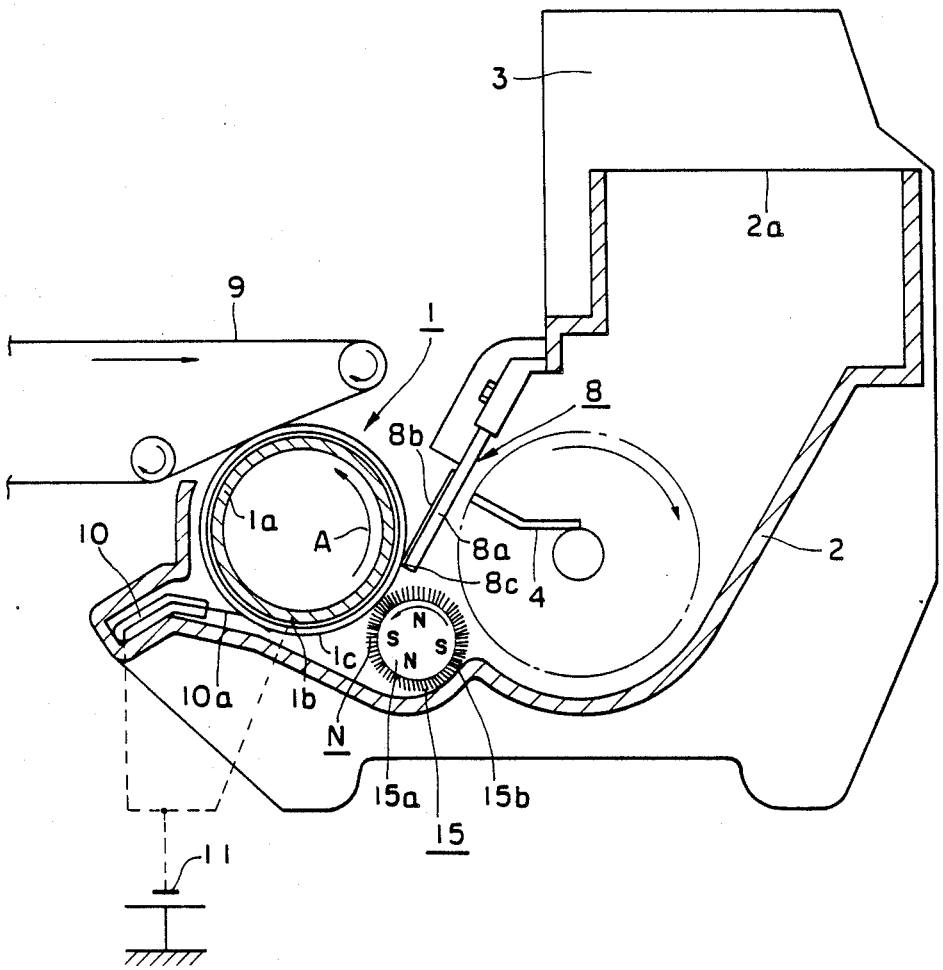

FIG. 9 shows a still further embodiment of the present developing device which is also similar in structure to the previously described embodiments. In the present embodiment, use is made of a magnetic brush device 15 as the developer supplying unit for supplying the developer from the hopper 2 to the developing sleeve 1. The magnetic brush device 15 includes a magnet roll 15*a* which is provided with elongated magnetic poles extending in the longitudinal direction and arranged around the circumference alternate in polarities at equal intervals. The magnet roll 15*a* is rotatably disposed and driven to rotate in the direction indicated by the arrow at constant speed adjacent to the developing sleeve 1 Magnetic particles, such as iron powder, are provided as magnetically attracted to the entire peripheral surface of the magnet roll 15*a* to define magnetic brush 15*b*, which rotates together with the magnet roll 15*a* while scrubbing the peripheral surface of the developing sleeve 1. As shown in FIG. 9, the magnetic brush 15*b* tends to be formed longer in the vicinity of each magnetic pole; however, the magnetic brush 15*b* may be made more uniform in height by increasing the density of magnetic poles. Thus, in order to make the scrubbing contact between the developing sleeve 1 and the magnetic brush 15*b* more uniform, the density of magnetic poles may be increased or the rotational speed of the magnet roll 15*a* may be increased. In this case, the suitable rotational speed of the magnet roll 15*a* differs depending on the peripheral speed of the developing sleeve 1, and if it is set at excessively high speed, can ensure, such as developer scattering, toner sticking at the bearings and promotion of developer clumping within the hopper 2. Thus, in order to attain a suitable scrubbing contact between the developing sleeve 1 and the magnetic brush 15*b*, the rotational speed of the magnet roll 15*a* is suitably set with respect to the peripheral speed of the developing sleeve 1 and then the density of magnetic poles 15*a* is suitably determined.

As described above, with the provision of the magnetic brush type developer supplying unit 5, the developer which has been stirred by the agitator 4 and fed from the hopper 2 is brought into contact with the magnetic brush 15*b* formed on the rotating magnet roll 15*a* and, as the developer becomes triboelectically charged opposite in polarity to the magnetic brush 15*b*, the developer becomes electrostatically attracted to the magnetic brush 15*b*. And, thus, the developer becomes carried as attracted to the magnetic brush 15*b* and brought to a scrubbing contact region N defined between the developing sleeve 1 and the magnetic brush unit 15 where the magnetic brush 15*b* is in scrubbing contact with the developing sleeve 1. Accordingly, the developer in the magnetic brush 15*b* comes to be scrubbed against the developing sleeve 1 at the scrubbing contact region N so that the developer is again triboelectrically charged strongly and then attracted to the developing sleeve 1.

In the structure shown in FIG. 9, the magnetic brush 15*b*, which serves as carrier beads in the so-called two-component developer system, is set in rotary motion together with the magnet roll 15*a* at the outlet port of the hopper 2, and, therefore, even if the developer is comprised of non-magnetic one-component toner having no carriers or magnetic material, the developer can be supplied from the hopper 2 to the developing sleeve 1 smoothly by an appropriate amount. In this case, the magnet particles forming the magnetic brush 15*b* remain magnetically attracted to the magnet roll 15*a* and they move circularly together with the magnet roll 15*a*, and, thus, these magnetic particles are most unlikely to adversely affect the developing performance. It is to be noted that an endless magnet belt may be provided in place of the magnet roll 15*a*, or, alternatively, use may be made of an electromagnet.

Figure 10:
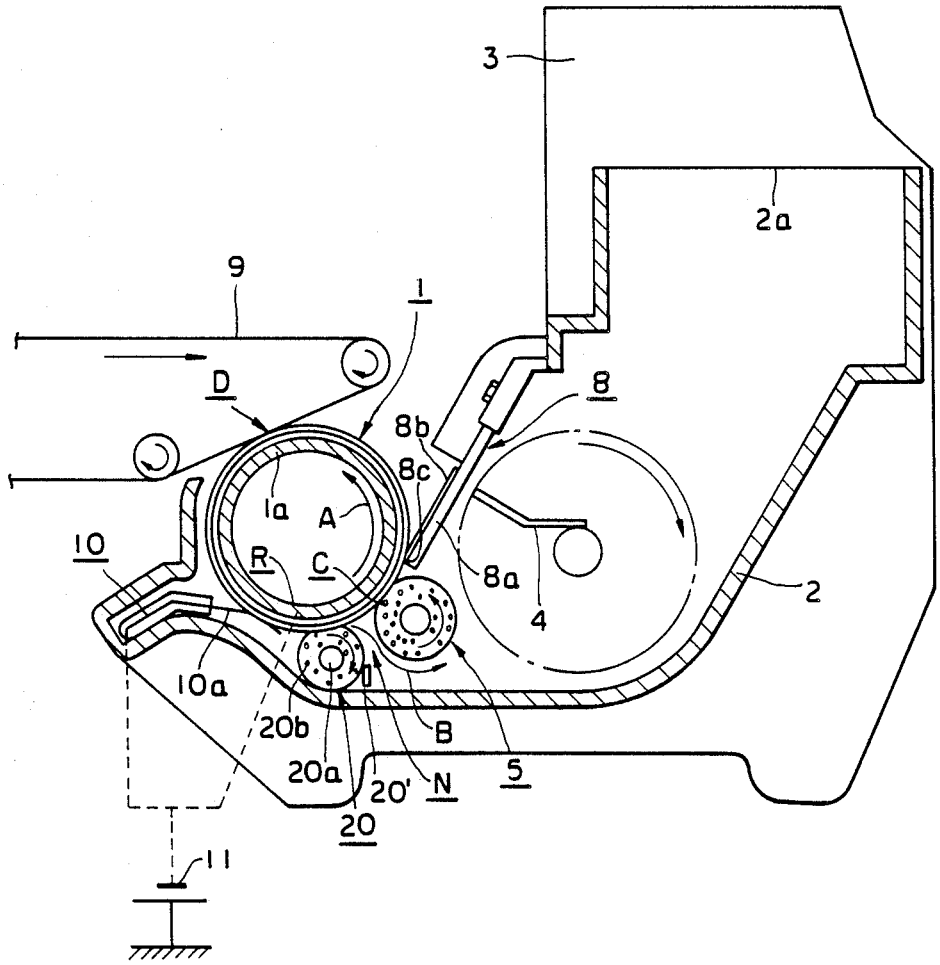

FIG. 10 shows a still further embodiment of the present developing device which is also similar in basic structure to the previously described embodiments. In the present embodiment, however, a developer scrape off roller 20 serves as a means for positively removing the residual developer remaining on the developing sleeve 1 to be returned to the hopper 2, is disposed at a location downstream of the discharging brush 10 but upstream of the developer supplying unit 5 with respect to the direction of rotation of the developing sleeve 1. The scrape off roller 20 is rotatably supported and in contact with the developing sleeve 1. In this case, the scrape off roller 20 is preferably driven to rotate opposite in rotating direction to the developing sleeve 1, and thus to the developer supplying roller 5, so that the scrape off roller 20 moves opposite in direction to the developing sleeve 1 in their contact region R and similarly opposite in direction to the developer supplying roller 5 in a gap N therebetween. With this arrangement, the developer remaining on the developing sleeve 1 is removed by the scrape off roller 20 and the thus removed developer is caused to advance through the gap N in the direction indicated by the arrow B smoothly toward the hopper 2. The peripheral speed of the scrape off roller 20 is preferably set higher than the peripheral speed of the developing sleeve 1 because, if so set, the scrape off roller 20 may scrape the developing sleeve 1 effectively to thereby remove the residual developer from the developing sleeve 1 efficiently. However, the rotational speed of the scrape off roller 20 also has an upper limit so as not to bring about other disadvantages, such as developer scattering.

The scrape off roller 20 of the illustrated embodiment includes a support roll 20*a* and a surface layer 20*b* formed on the outer peripheral surface of the roll 20*a* from a polyurethane foam. Thus, the scrape off roller 20 is deformable and porous in nature, and since it may be disposed to be pressed against the developing sleeve 1, there is formed an area contact between the scrape off roller 20 and the developing sleeve 1, which allows to securely remove the residual developer as scraped from the developing sleeve 1. Thus, the residual developer, which has been subjected to the remaining charge removing operation, and thereby has lost its electrostatic attractive force substantially, comes to be transported to a position where the scrape off roller 20 is disposed as the developing sleeve 1 rotates, and, thus, the residual developer is securely removed from the developing sleeve 1 by the scrape off roller 20 in scrubbing area contact with the developing sleeve 1. The developer thus removed passes through the gap N between the scrape off roller 20 and the developer supplying roller 5 along the path indicated by B to be returned to the hopper 2. Also provided fixed in position and in contact with the outer peripheral surface of the scrape off roller 20 is a knock off bar 20' which serves to remove the scraped off developer from the scrape off roller 20 thereby helping to maintain the scrape off performance at a predetermined level.

As described above, in the structure shown in FIG. 10, the developer remaining on the developing sleeve 1 is once positively removed from the developing sleeve 1 for possible reuse in subsequent developing operation so that the sticking of developer is prevented from occurring and the developing performance may be maintained constant. As further modifications, the surface layer 20*b* of the scrape off roller 20 may be comprised of a flexible material, such as rubber, a metal or the like instead of the flexible porous material as set forth above. If the scrape off roller 20 has an electrically conductive outer peripheral surface which is electrically connected to a bias voltage source similarly with the discharging brush 10, then it also functions as a discharging unit for removing undesired charge from the developing sleeve 1, in which case the discharging brush 10 can be omitted.

In the above-described embodiments, the scrape off units are all rotating type, but the scrape off unit to be provided in the present developing device should not be limited to the rotating type, and the stationary type, such as a blade, may also be used. In this case, the scrape off blade is preferably comprised of such a material as rubber, in particular urethane rubber, fluorine resin, high polymer like polyethylene, and metallic elastic member.

Figure 11:
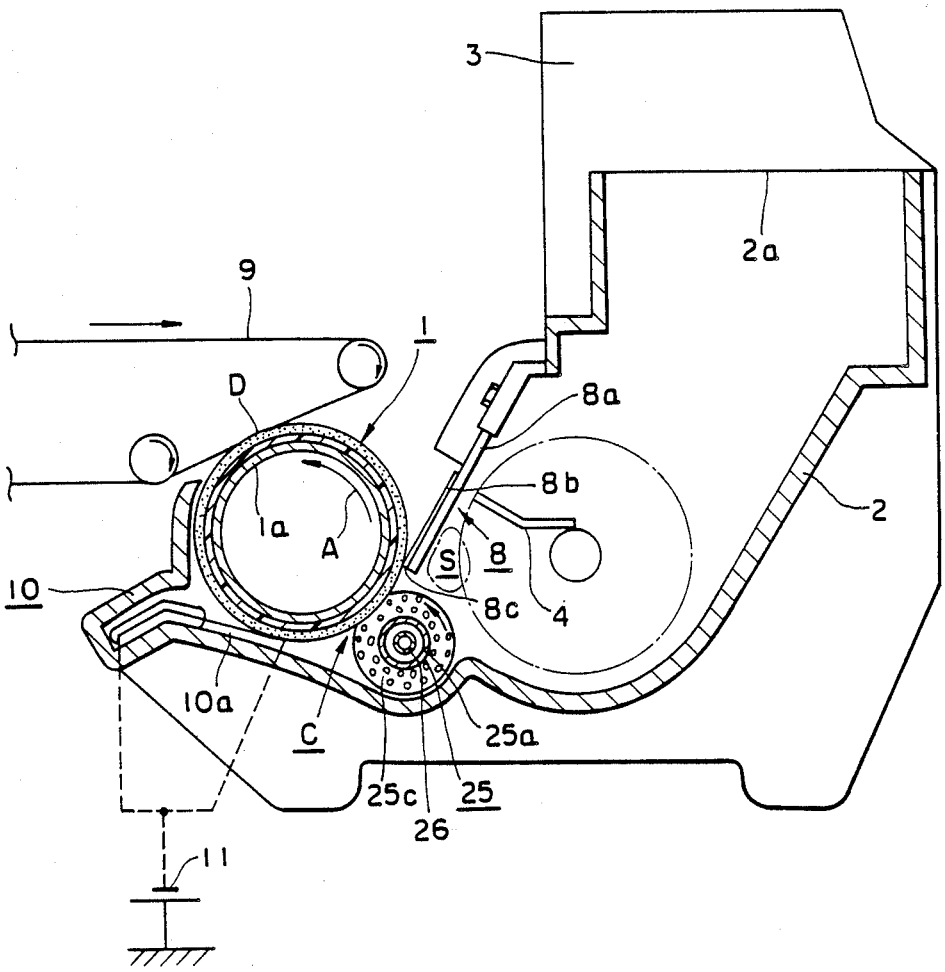
Figure 12:
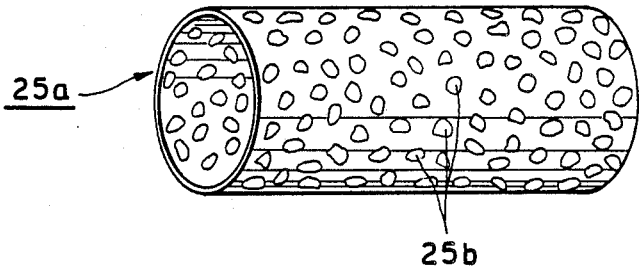
FIG. 12 is a perspective view showing a perforated cylindrical support provided in the structure shown in FIG. 11.

FIG. 11 shows a still further embodiment of the present developing device which is also structurally similar to the previously described embodiments in many respects. The present embodiment is provided with a developer supplying roller 25 for supplying the developer from the hopper 2 to the developing sleeve 1. The developer supplying roller 25 of the present embodiment includes a perforated cylindrical support 25*a* which is provided with a number of through-holes 25*b* uniformly distributed across the peripheral surface thereof as best shown in FIG. 12. The developer supplying roller 25 also includes a surface layer 25*c*, formed on the outer peripheral surface of the cylindrical support 25*a* from a porous material. The material forming the surface layer 25*c* is preferably selected to be separated away from the developer in terms of triboelectric series so as to be able to charge the developer triboelectrically efficiently, and the pores of the surface layer 25*c* are preferably smaller in size as compared with the size of toner particles.

Figure 13:
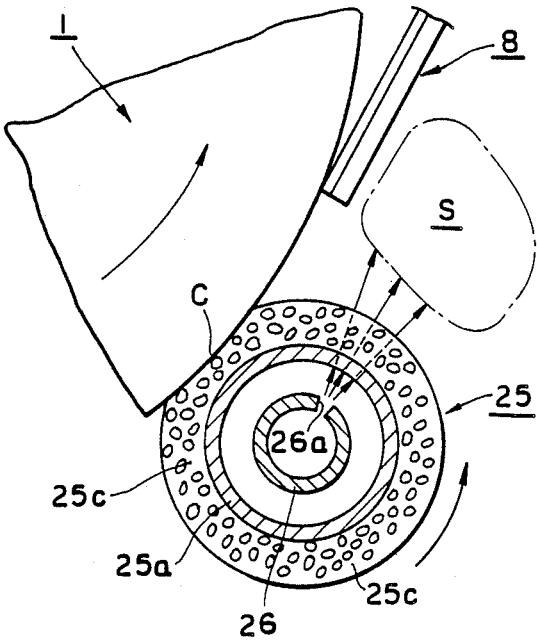
FIG. 13 is a schematic illustration showing on an enlarged scale the main portion of the structure shown in FIG. 11.

In the present embodiment, as best shown in FIG. 13, the developer supplying roller 25 is basically a sponge roller comprised of the cylindrical support 25*a* and the surface layer 25*c* formed on the support 25*a* from a foam material, such as polyurethane foam, preferably, having the number of foam cells in the order of 10–100. The cylindrical support 25*a* is rotatably supported and a air tube 26 is provided as extending inside of the cylindrical support 25*a*. The air tube 26 is provided with a plurality of slit-shaped openings 26*a* as arranged axially and disposed to be directed toward the stagnating region S. The air tube 26 is connected to a compressed air source so that air under pressure is supplied to the air tube 26 and the air under pressure is discharged through the slits 26*a* into the interior of the cylindrical support 25*a*. Since the cylindrical support 25*a* is perforated and the surface layer 25*c* is porous, the air under pressure discharged from the air tube 26 passes through the cylindrical support 25*a* and through the foam layer 25*c* toward the stagnating region S, to help prevent developer agglomeration in the stagnating region S.

With this passage of air under pressure, the foam layer 25*c* is kept from being plugged with developer, thereby ensure the smooth and stable supply of developer to the developing sleeve 1. Furthermore, since the air under pressure may be passed through the entire foam layer 25*c* in all radial directions, though it is true that the main stream is directed toward the stagnating region S, the developer is prevented from agglomerating also in regions other than the stagnating region S. It is to be noted that the air tube 26 may be discarded, if desired, and the air under pressure may be directly fed into the interior of the cylindrical support 25*a*.

The developer supplying roller 25 having the above-described structure is preferably disposed at a position with its outer peripheral surface pressed against the developing sleeve 1 and is driven to rotate in the same rotating direction as the developing sleeve 1. That is, at the area contact region C between the developing sleeve 1 and the roller 25, the developing sleeve 1 moves in the direction opposite to that of the sponge roller 25 in sliding contact therebetween. With this structure, the developer becomes sandwiched under pressure between the developing sleeve 1 and the sponge roller 25 whereby the developer becomes triboelectrically charged and regulated in thickness to define a desired thin film of charged developer on the outer peripheral surface of the developing sleeve 1.

As an alternative structure, the developer supplying roller 25 may be disposed to be separated away from the developing sleeve 1. Even in such a non-contact arrangement, the developer may be suitably supplied to the developing sleeve 1.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A device for developing an electrostatic latent image by applying a thin film of developer formed on an image bearing member comprising:

storing means for storing therein a quantity of one-component developer, said storing means having an outlet port at a predetermined location;

transporting means for transporting said developer along a predetermined path through a developing region where said developer is applied to said image bearing member to develop said latent image; and supplying means including a cylindrical support and a flexible layer formed on said cylindrical support, said supplying means being disposed in the vicinity of said outlet port of said storing means for receiving said developer from said storing means to be supplied to said transporting means, said supplying means being supported to be rotatable and driven to rotate in a first predetermined direction so as to be in sliding contact with said transporting means and to thereby cause said developer to be formed into a thin film of charged developer on said transporting means; and wherein said transporting means includes a developing sleeve comprised of a cylindrical support, an intermediate layer formed on said support and an electrode layer formed on said intermediate layer, said electrode layer being comprised of a dielectric material with a plurality of fine electrode particles dispersed therein and separated from one another, and said sleeve being rotatably supported and driven to rotate in a second predetermined direction.

2. The device of claim 1 wherein said supplying means includes a cylindrical support and a flexible layer formed on said cylindrical support of the supplying means, wherein said cylindrical support of the supplying means is driven to rotate in said first predetermined direction, with said flexible layer pressed against said transporting means; and wherein said flexible layer is comprised of a foam material.

3. The device of claim 2 wherein said foam material is sponge.

4. The device of claim 1 wherein said first and second predetermined directions are in the same rotating direction.

5. The device of claim 1 further comprising a doctor blade disposed downstream of said supplying means with respect to the direction of said developing sleeve, said doctor blade having a free end pressed against the outer peripheral surface of said developing sleeve to cause said thin film of developer on said developing sleeve to be further charged and regulated in thickness.

6. The device of claim 5 wherein said doctor blade is comprised of an elastic material and is provided with an insulating film on one surface thereof, said doctor blade being pressed against said developing sleeve with said insulating film in contact therewith.

7. The device of claim 6 wherein said insulating film is comprised of a fluorine family resin.

8. The device of claim 7 wherein said fluorine family resin includes tetrafluoroethylene-perfluoroalkylvinylether copolymer.

9. The device of claim 1 further comprising discharging means disposed downstream of said developing region with respect to the direction of rotation of said sleeve for removing undesired charge from said developing sleeve and said developer remaining on said sleeve.

10. The device of claim 9 wherein said discharging means is connected to a predetermined bias potential.

11. The device of claim 10 wherein said cylindrical support of said developing sleeve is electrically conductive and electrically connected to a developing potential which is equal to said predetermined bias potential.

12. The device of claim 9 wherein said discharging means includes an electrically conductive brush which extends generally tangentially in a trailing direction with respect to said developing sleeve and is lightly pressed thereagainst.

13. The device of claim 9 wherein said discharging means includes a sponge roller which is disposed to be in rolling contact with said developing sleeve, said sponge roller having an electrically conductive peripheral surface which is connected to a predetermined bias potential.

14. The device of claim 13 wherein said predetermined bias potential includes both d.c. and a.c. components.

15. The device of claim 5 further comprising guiding means disposed in the vicinity of the sliding contact between said developing sleeve and said doctor blade for guiding developer rejected by said doctor blade toward said outlet port of said storing means.

16. The device of claim 15 wherein said guiding means includes a fur brush rotatably supported and driven to rotate in a predetermined direction.

17. A device for developing an electrostatic latent image by applying a thin film or developer formed on an image bearing member comprising:

storing means for storing therein a quantity of one-component developer, said storing means having an outlet port at a predetermined location;

transporting means for transporting said developer along a predetermined path through a developing region where said developer is applied to said image bearing member to develop said latent image; and supplying means including a cylindrical support and a flexible layer formed on said cylindrical support, said supplying means being in the vicinity of said outlet port of said storing means for receiving said developer from said storing means to be supplied to said transporting means, said supplying means being supported to be rotatable and driven to rotate in a first predetermined direction so as to be in sliding contact with said transporting means and to thereby cause said developer to be formed into a thin film of charged developer on said transporting means; and removing means for removing developer remaining on said transporting means after passing through said developing region before said supplying means.

18. The device of claim 17 in which said removing means comprises a scrape off roller making rubbing contact with said transporting means.

19. The device of claim 18 in which said transporting means comprises a rotating developing sleeve and said scrape off roller rotates in an angular direction opposite that of said developing sleeve.

20. The device of claim 19 in which the peripheral speed of said scrape off roller at the area of contact thereof with said developing sleeve is higher than the peripheral speed of said developing sleeve.

21. The device of claim 18 in which the surface of said scrape off roller which makes contact with said transporting means is made of a deformable and porous material.

22. The device of claim 21 in which said deformable and porous material comprises polyurethane foam.

23. THe device of claim 18 in which the surface of said scrape off roller which makes contact with said transporting means is made of a flexible material.

24. The device of claim 18 in which said transporting means has an interior electrically conductive portion which is at a selected bias potential and the surface of said scrape off roller which makes contact with said transporting means is electrically conductive and is at a bias matching said selected bias.

25. The device of claim 17 in which said removing means comprises a stationary unit.

26. The device of claim 25 in which said stationary unit is made of a material selected from the group consisting of rubber, urethane rubber, fluorine resin, polyethylene and metallic elastic material.

* * * * *